United States Patent [19]

Hayashi

[11] 4,392,564

[45] Jul. 12, 1983

[54] TOTAL SALES SUMMING DEVICE FOR A VENDING MACHINE

[75] Inventor: Yukichi Hayashi, Sakado, Japan

[73] Assignee: Kabushiki Kaisha Nippon Coinco, Tokyo, Japan

[21] Appl. No.: 233,462

[22] Filed: Feb. 11, 1981

[30] Foreign Application Priority Data

Feb. 14, 1980 [JP] Japan ..... 55-16965
Mar. 18, 1980 [JP] Japan ..... 55-33506[U]

[51] Int. Cl.³ ..... G07F 5/22
[52] U.S. Cl. ..... 194/1 N; 194/10
[58] Field of Search ..... 194/1 N, 1 M, 10, DIG. 2, 194/DIG. 14

[56] References Cited

U.S. PATENT DOCUMENTS 4,008,792 2/1977 Levasseur et al. ..... 194/1 N

*Primary Examiner*—Stanley H. Tollberg
*Attorney, Agent, or Firm*—Spensley, Horn, Jubas & Lubitz

[57] ABSTRACT

An up-down counter of a vending machine performs upcounting and downcounting in accordance with deposition and pay-out of coins and collection of a vend price, thereby producing a balance of an amount of deposited coins. The count of this up-down counter is indicated by a money amount indicator. A total sales summing device introduces, through a connector, money amount indication data provided from the up-down counter to the money amount indicator and performs a sales amount summing processing in accordance with this money amount indication data. This summing device detects the increment and decrement of the money amount indication data, performs up-counting and downcounting in response to this increment and decrement and prohibits downcounting of the decrement in the money amount indication data when the decrement has been caused by collection of the vend price. By virtue of the count prohibition control the difference between the amount of the deposited coins and the paid out coins, i.e., the price of the vended article, is left whereby summing of the sales amount is made possible. In a case where the vending machine has a plurality of article dispensing columns, a sales amount may be summed up for each column by receiving a vend mode signal representing one of the columns which has entered a vend mode.

11 Claims, 7 Drawing Figures

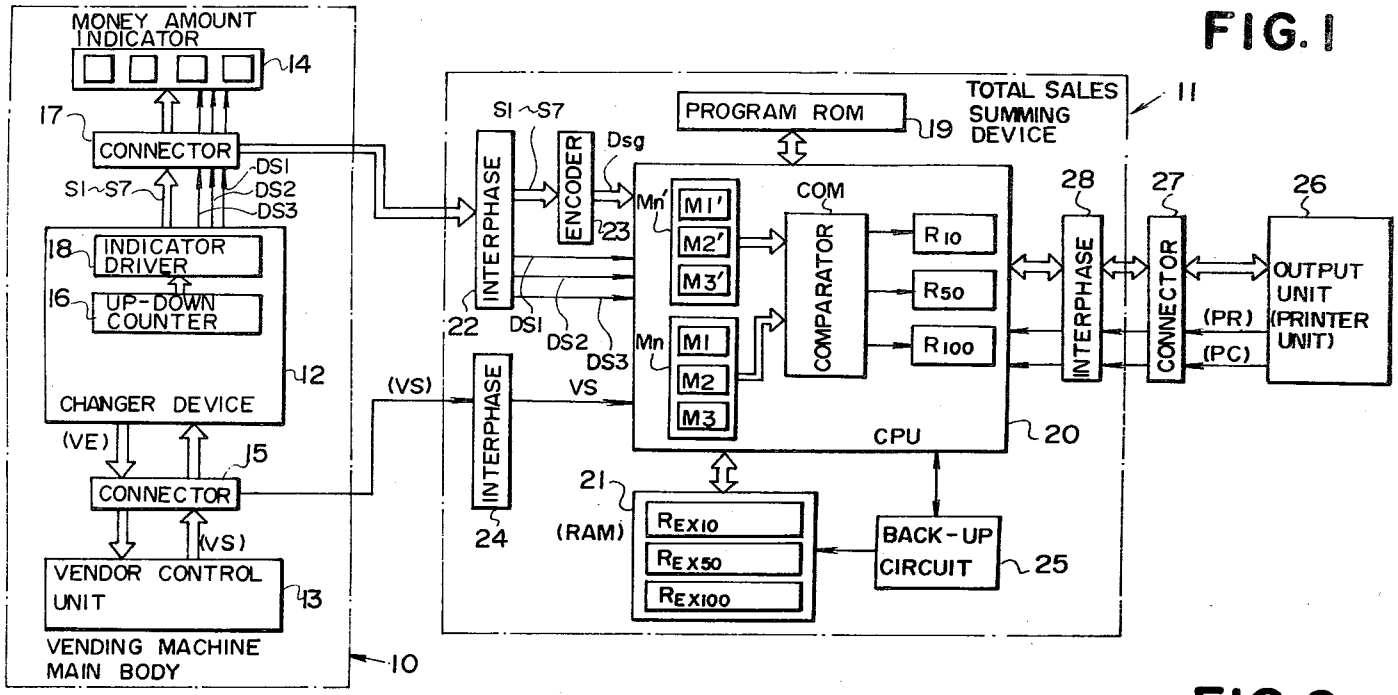
FIG. 1
TOTAL SALES SUMMING DEVICE
11
PROGRAM ROM
19
COMPARATOR
COM
R10
R50
R100
CPU
20
BACK-UP CIRCUIT
25
M1'
M2'
M3'
M1
M2
M3
Mn'
Mn
REX10
REX50
REX100
21
(RAM)
Dsg
23
ENCODER
S1~S7
DS1
DS2
DS3
VS
INTERPHASE
22
INTERPHASE
24
CONNECTOR
27
INTERPHASE
28
OUTPUT UNIT (PRINTER UNIT)
26
(PR)
(PC)
(VS)
10
MONEY AMOUNT INDICATOR
14
CONNECTOR
17
INDICATOR DRIVER
18
UP-DOWN COUNTER
16
CHANGER DEVICE
12
(VE)
CONNECTOR
15
VENDOR CONTROL UNIT
13
VENDING MACHINE MAIN BODY

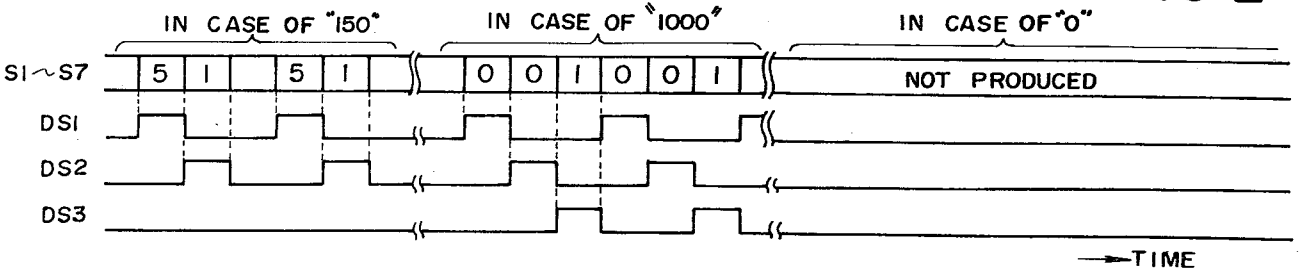
FIG. 2
IN CASE OF "0"
NOT PRODUCED
IN CASE OF "1000"
IN CASE OF "150"
S1~S7
DS1
DS2
DS3
TIME

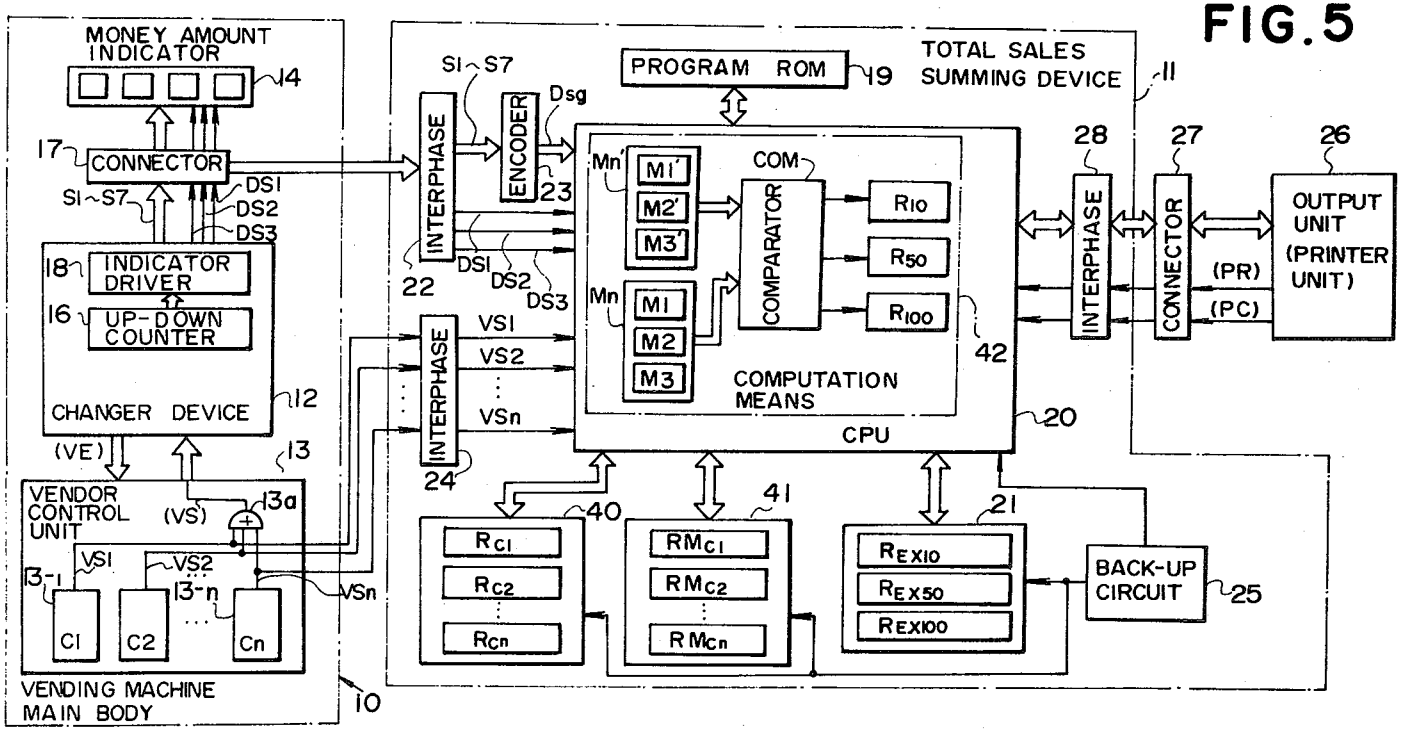
FIG. 5
OUTPUT UNIT (PRINTER UNIT)
26
(PR)
(PC)
CONNECTOR
27
INTERPHASE
28
11
TOTAL SALES SUMMING DEVICE
20
42
BACK-UP CIRCUIT
25
21
R10
R50
R100
COMPARATOR
COM
COMPUTATION MEANS
CPU
REX10
REX50
REX100
PROGRAM ROM
19
M1'
M2'
M3'
M1
M2
M3
Mn'
Mn
41
RMC1
RMC2
RMCn
40
RC1
RC2
RCn
Dsg
ENCODER
23
DS1
DS2
DS3
VS1
VS2
VSn
S1~S7
INTERPHASE
22
INTERPHASE
24
Sn
10
MONEY AMOUNT INDICATOR
14
CONNECTOR
17
S1~S7
INDICATOR DRIVER
18
UP-DOWN COUNTER
16
CHANGER DEVICE
12
(VE)
13
13a
VENDOR CONTROL UNIT
(VS)
VS2
13-n
Cn
C2
VS1
13-1
C1
VENDING MACHINE MAIN BODY

TOTAL SALES SUMMING DEVICE FOR A VENDING MACHINE

BACKGROUND OF THE INVENTION

This invention relates to a device for summing sales amount in a vending machine.

In a prior art sales amount summing device for a vending machine, signals representing prices of vended articles are picked up directly from a circuit in the vending machine for a cumulative addition. If the number of articles to be vended is large, the number of the vend price signals to be picked up is also large with a result that wiring becomes extremely complicated. In view of overcoming this drawback, the prior art sales amount summing device is generally incorporated integrally in a changer device of the vending machine so as to avoid the occurrence of confusion due to a large number of long wires for transmitting the vend price signals. Since the summing device needs to be incorporated integrally in the circuit of the changer device, demand for a vending machine with a summing device entails manufacture of a special changer device incorporating a summing device in a process of manufacturing the changer device. Accordingly, if one desired to provide a summing device additionally to an existing changer device which has not such summing device, a cumbersome change in the circuit design of the changer device is required, making addition of the summing device extremely difficult. If, on the other hand, the summing device is initially incorporated in all changer devices, it will entail an unnecessary expense to those users who do not need such summing device.

In a vending machine having a plurality of article dispensing columns (hereinafter referred to as columns), it is desirable to sum up sales amount for each of these columns. For this purpose, two methods have heretofore been proposed.

One of the methods is to provide a counter for the summing purpose in each of the columns, picking up a vend price setting signal, column by column, from the changer device of the vending machine in the above described manner and sum up vend price setting signals for each column in which one or more articles have been vended by a counter corresponding to the column. The other method is to provide a counter for summing the number of vended articles for each of the columns, and obtain sales amount by columns by multiplying the number of the vended articles in each counter with a set vend price for the column stored previously in the summing device. The former method is disadvantageous in that vend price setting signals for the respective columns must be picked up from the circuit in the changer device and supplied to the summing device with resulting complexity in wirings. Further, drawing out of wires for the vend price setting signals for the respective columns sometimes obliges cumbersome change in the circuit in the changer device. If the summing device (i.e. counters for the summing purpose) are initially installed in the changer device for avoiding the later change in the circuit, such changer device incorporating the summing device entails, as described above, increase in the cost which is quite unnecessary for those who do not require such summing device. The latter method obviates the necessity to pick up vend price setting signals for the respective columns from the changer device and supply them to the summing device. The latter method, however, requires provision of a price setting switch or the like device for enabling storage of set vend prices for the respective columns on the side of the summing device with a resulting increase in the case.

Furthermore, the prior art summing device of the type in which vend price setting signals are directly picked up and summed up is incapable of summing up amounts of money collected in the vending machine by denominations. For enabling summing up amounts of money by denominations, it is conceivable to pick up output signals of switches for detecting deposited coins by denominations and signals representative of denominations of coins having been paid out as change from some suitable points in the circuit of the vending machine and add or subtract these signals by denominations. This arrangement, however, complicates wirings for picking up the singals and obliges change of the circuit in the changer device for drawing out wires.

SUMMARY OF THE INVENTION

It is, therefore, an object of the invention to provide a novel total sales summing device for a vending machine requiring no cumbersome wiring or change in the circuit.

It is another object of the invention to provide a total sales summing device which need not be fixedly incorporated in the circuit of the vending machine from the outset but can be readily attached to an existing vending machine later.

It is another object of the invention to provide a total sales summing device capable of summing up sales amount for respective columns without requiring extracting vend price setting signals for respective columns individually from the changer device and without prestoring set vend prices in the summing device.

It is still another object of the invention to provide a total sales summing device for a vending machine capable of summing up sales amounts by denomination without requiring cumbersome drawing out of wires from coin detection switches or the like.

The above described various objects can be achieved by a total sales summing device in which depositing and paying out of coins in a vending machine are detected by utilizing a signal representing a balance amount of deposited coins and a summing processing is performed in accordance with this detection. More specifically, the summing device according to the invention comprises first means for detecting increment and decrement in a balance of an amount of deposited coins counted by counter means provided in the vending machine by receiving a signal representing the balance and watching variation of the balance, second means for conducting count-up or count-down in accordance with the increment or decrement in the balance upon the detection by said first means and third means for substantially prohibiting counting by said second means of decrement of the balance if the decrement has been caused by subtraction for collecting a vend price, and increment and decrement in the balance caused by deposition and paying out of a coin only is counted up or down by said second means.

This signal representing the balance of the amount of deposited coins increases by an amount of a coin when the coin has been deposited whereas it decreases by an amount of a coin when the coin has been paid out as change. Accordingly, the price of a vended article, i.e. sales amount, can be obtained as difference between the amount of deposited coin or coins and the amount of paid-out coin or coins by conducting upcounting and downcounting in accordance with increment and decrement of the signal representing the balance and prohibiting counting of decrement of the balance caused by collection of the vend price. A total sum of sales can be obtained by cumulatively adding the sales amount obtained at each vending. The signal representing the balance of the amount of deposited coins can be picked up relatively easily from the change device of the vending machine so that no cumbersome wirings or change in the circuit is required.

As the signal representing the balance of the amount of deposited coins, money amount indication data provided to a money amount indicator by an up-down counter (count of which indicates the balance of the amount of deposited coins) disposed in the changer device of the vending machine can conveniently by utilized. As is well known, the money amount indicator functions to indicate the balance of the amount of deposited coins. By providing a connector in a money amount indication data transmission route from an up-down counter in the changer device to the money amount indicator so as to pick up the money amount indication data from this connector and deliver it to the summing device, the requirement for the change in the circuit of the changer device is obviated and the summing device can be easily attached to an existing vending machine. All existing types of vending machines have a wiring for the connector for delivering the money amount indication data from the changer device to the money amount indicator. The money amount indication data can be transmitted from this connector to the summing device according to the invention.

Since the signal representing the balance of the amount of deposited coins, i.e., the money amount indication data, increases or decreases each time a coin has been deposited or paid out, denomination of the deposited or paid out coin can be readily detected from variation (i.e. increment or decrement) of the signal by continuously watching the variation of the signal. Accordingly, sales amount for each denomination can be summed up by discriminating the denomination of the deposited or paid out coin from the variation in the balance signal, i.e., the money amount indication data and conducting addition of deposited coins and substraction of paid out coins denomination by denomination.

For discriminating whether decrease in the signal representing the balance of the amount of deposited coins, i.e., the money amount indication data, has been caused by substraction for collecting the vend price or by paying out of a coin as a change, a predetermined signal generated in the vending machine in collecting the vend price is received in the summing device and the decrement produced in the balance signal, i.e., the money amount indication data, in response to generation of this predetermined signal is judged to have been caused by collection of the vend price. By way of example, a vend start signal representing the fact that vending has been started is utilized as this predetermined signal.

The total sales summing device achieving one of the above described other objects of the invention comprises means for detecting increment and decrement in the balance of the amount of deposited coins, i.e., the money amount indication data, operation means for computing a vend price collected by the vending machine by upcounting the detected increment, disregarding the detected decrement when it has been caused by substraction for collecting the vend price and downcounting the detected decrement caused for other reason, and sales amount counting and storage means provided for respective columns for cumulatively adding the vend price which has been computed by said operation means in accordance with the column from which a vended article has been disposed. The column from which the article has been dispensed can be detected by a vend mode signal for each column generated in the vending machine. The vend mode signal may be picked up from an article selection switch for the corresponding column or from a drive circuit for an article dispensing drive means (i.e., solenoid, motor or the like) for the corresponding column. Any signal that is available for detecting that each individual column has entered the vend mode (i.e., article dispensing mode) may be utilized as the vend mode signal.

Since summing of sales amounts by columns can be effected by utilizing the signal representing the balance of the amount of deposited coins, i.e., the money amount indication data, the vend price setting signals for the respective columns need not be picked up from the changer device of the vending machine to be supplied to the summing device or vend price for each column need not be stored in the summing device but sales amounts and the number of vended articles for the respective columns can be summed up with a very simple construction. If the wirings required for receiving the money amount indication data are compared with the wirings required for individually receiving the vend price setting signals for the respective columns, the former will apparently be of a much simpler construction. Likewise, if the wirings required for receiving the money amount indication data are compared with the means (including switches) for individually setting and storing vend prices for the respective columns, the former will be of a much simpler construction.

BRIEF DESCRIPTION OF THE DRAWINGS

In the accompanying drawings:

FIG. 1 is a block diagram showing an embodiment of the total sales summing device made according to the invention;

FIG. 2 is a time chart showing an example each of segment signals and digit strobe pulses which constitute the money amount indication data;

FIG. 5 is a block diagram showing another embodiment of the total sales summing device made according to the invention.

DESCRIPTION OF PREFERRED EMBODIMENTS

Figure 3:
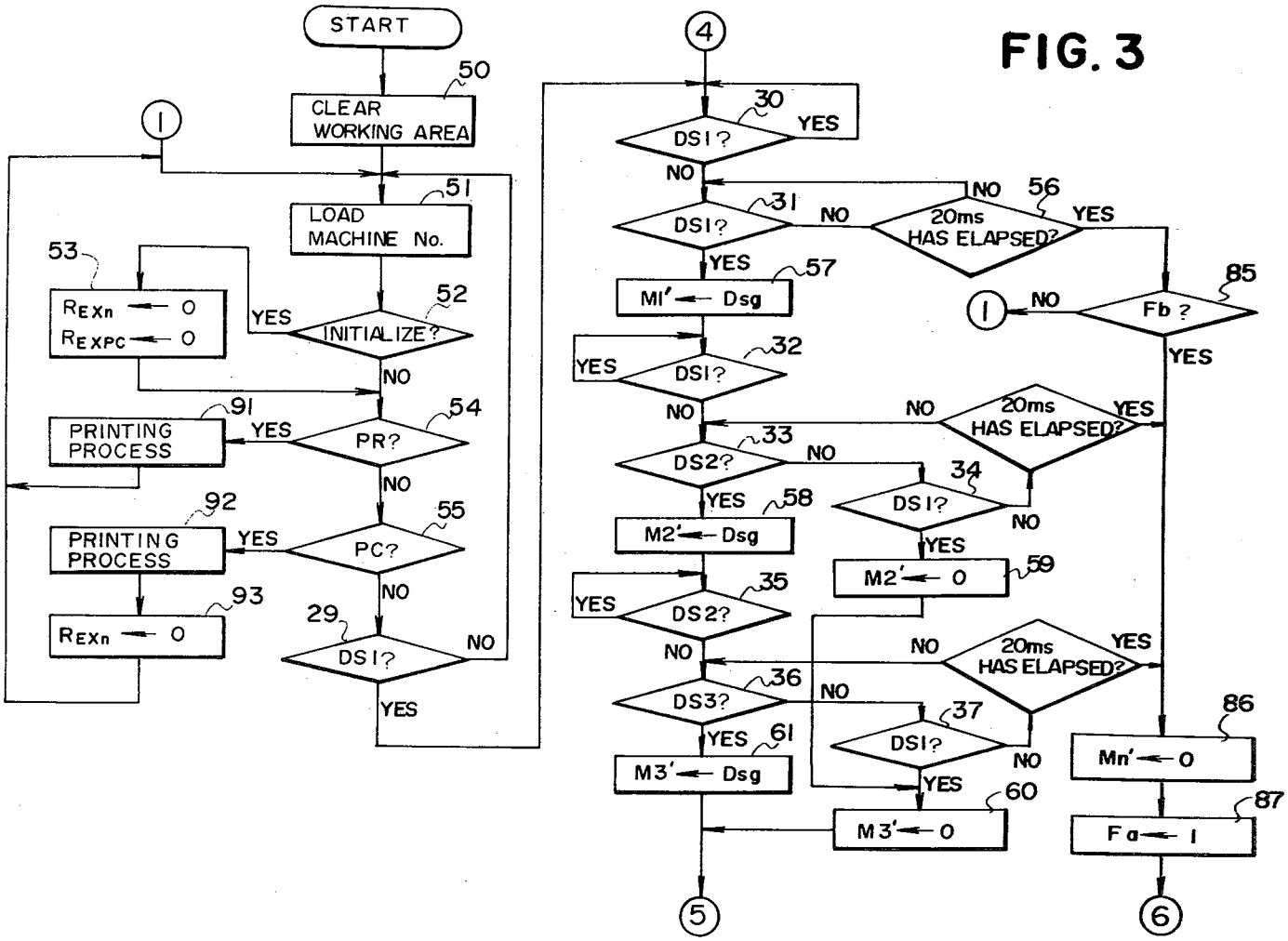
FIGS. 3 and 4 are flow charts showing an example of a summing processing program implemented in the summing device of FIG. 1.

Referring first to FIG. 1, a vending machine main body 10 is a vending machine of any known construction and a total sales summing device 11 of the present invention is additionally provided to the vending machine main body. The vending machine main body 10 generally comprises a changer device 12, a vendor control unit 13 and a money amount indicator 14. The changer device 12 performs various known functions such as discriminating true coins from counterfeit coins from among deposited coins and accepting only true coins, cumulatively counting the amount of the accepted coins and generating a vend possible signal VE corresponding to a vendible article within the amount of the deposited coins in accordance with comparison of the amount of the deposited coins with a preset vend price, and substracting the vend price of the vended article from the amount of the deposited coins and paying out the balance as a change. The vendor control unit 13 receives the end possible signal VE generated in the changer device 12 and dispenses (delivers out) an article selected by operation of an article selection switch (not shown) if such article is vendible and delivers a vend start signal VS representing that the vending machine is in an article dispensing mode (i.e. vend mode) to the changer device 12. The changer device 12, upon receipt of the vend start signal VS, subtracts the set vend price of the vended (i.e. selected) article from the amount of the deposited coins to calculate the amount of the change and thereafter pays out coins corresponding to the amount of the change. An electrical (electronic) circuit portion in the changer device 12 is designed as a unit and is detachably connected to an electrical circuit portion in the vendor control unit by means of a connector 15. Signals including the vend possible signal VE and the vend start signal VS are delivered and received through lines provided through the connector 15.

The changer device 12 includes an up-down counter 16 which cumulatively adds the amounts of the deposited coins and subtracts the price of the vended article and also the amount of the paid out change. The amount which has been counted by the counter 16 (i.e. the amount of the deposited coins or the balance thereof) is indicated by the money amount indicator 4. For this purpose, the changer device 12 is detachably connected to the money amount indicator 14 by means of a connector 17 and a signal representing the counted amount in the up-down counter 16 is supplied to the money amount indicator 14 via the connector 17.

A counting result of the up-down counter 16 changes by deposition of coins and paying out of change. Upon each deposition of a coin, the count of the counter 16 increases by the amount equivalent to the denomination of the deposited coin whereas the count decreases by the amount equivalent to the vend price upon each vending and also decreases by the amount of the change upon each paying out of the change. Assume, for example, a case wherein coins totaling 130 yen have been deposited in the order or 10 yen, 50 yen, 10 yen 10 yen and 50 yen, an article of 100 yen has been vended and three 10-yen coins (i.e. 30 yen) have been paid out as a change in sequence. The count of the up-down counter 16, i.e. the money amount indication signal supplied to the money amount indicator 14, changes from "0 " to "10", "60", "70", "80", "130" "30", "20", "10" and finally to "0". It is to be noted that subtraction of the vend price (100 yen) from the total deposited amount (130 yen) is conducted only after the generation of the vend start signal VS.

The denomination of each deposited or paid out coin can be detected by variation (increment or decrement) of the count of the up-down counter 16, i.e. variation (increment or decrement) of the money amount indication signal of the money amount indicatior 14. The summing device 11 watches the state of the money amount indication signal provided from the changer device 12 to the money amount indicator 14 and adds up the amounts of the deposited coins and subtracts the amounts of the paid out coins, denomination by denomination, in accordance with increment and decrement of the money amount indication signal. No subtraction, however, is made in the summing device 11 in a case where the money amount indication signal is decreased by the subtraction of the vend price. The subtraction of the vend price is detected by generation of the vend start signal VS. The amount of the coins accepted as the vend price in the vending machine (i.e. sales amount) is counted for each denomination in the device 11 by adding up the amounts of the deposited coins for each denomination and subtracting the amount of the paid out coins for each denomination.

An example of the money amount indication signal provided from the changer device 12 to the money amount indicator 14 and an example of the summing device 11 will now be described in detail.

In the changer device 12, the count of the up-down counter 16 is outputted after being converted to a predetermined indication element drive signal in an indicator driver 18. The indication elment drive signal is composed, for example, of seven segment signals S1–S7 and digit strobe pulses DS1, DS2 and DS3. Each of the segment signals S1–S7 corresponds to one of seven indication elements constituting one indication digit. As is well known, each of the indication digits of the indicator 14 can display any one of numerals 0 to 9 by suitably combining lighting of the seven indication elements. For indicating a desired numeral, predetermined ones of the segment signals S1 to S7 assume a state "1" whereas the rest of the segment signals assume a state "0".

The money amount indicator 14 has four indication digits of 1, 10, 100 and 1,000 among which the digit of 10 is fixed to 0. This is because the minimum denomination of coins to be used in the vending machine is 10 yen. Accordingly, the money amount indicator 14 is capable of indicating amounts up to 9,990 yen. The segment signals S1–S7 are outputted from the changer device 12 (indicator driver 18) in a state corresponding to each of the indication digits of 10, 100 and 1,000 on a time shared basis. Each of the digit strobe pulses DS1, DS2 and DS3 which are generated in synchronism with the time shared generation timing of the segment signals S1–S7 indicates a specific digit to which the presently produced segment signals correspond. The pulse DS1 represents the digit of 10, the pulse DS2 the digit of 100 and the pulse DS3 the digit of 1,000 respectively. The digit strobe pulses DS1, DS2 and DS3 are generated in correspondence to digits in which some numerals (0 to 9) are to be indicated. When the count of the up-down counter 16 is 0, the digit strobe pulses DS1–DS3 as well as the segment signals S1–S7 are not generated.

An example of a manner of generation of the digit strobe pulses DS1, DS2 and DS3 is shown in FIG. 2. If, for instance, "150 yen" is to be indicated, the pulse DS1 is generated when the segment signals S1–S7 for indicating "5" in the digit of 10 are produced and the pulse DS2 is generated when the segment signals S1–S7 for indicating "1" in the digit of 100 are produced. Since no numeral is indicated in the digit of 1,000 in this case, the digit strobe pulse DS3 corresponding to the digit of 1,000 is not generated and pulses DS1 and DS2 only are repeatedly generated. If "1,000 yen" is to be indicated, the pulses DS1, DS2 and DS3 are generated in correspondence to the segment signals S1–S7 for the numeral "0" of the digit of 10, the numeral "0" for the digit of 100 and the numeral "1" of the digit of 1,000. For indicating "0", no segment signals S1–S7 are generated and, accordingly, no pulses DS1–DS3 are generated.

Lines for the money indication signals which are sent out by the changer device 12, i.e. 10 lines for the segment signals S1–S7 and the digit strobe pulses DS1–DS3, are connected to the money amount indicator 14 through the connector 17. The same money amount indication signals, i.e. the segment signals S1–S7 and the pulses DS1–DS3, that are delivered out of the connector 17 are supplied also to the summing device 11. On the other hand, the vend start signal VS which is supplied from the vender control unit 13 to the changer device 12 through the connector 15 is also supplied to the summing device 11 from the connector 15.

In this embodiment, the summing device 11 is composed of a microcomputer and includes a program ROM (read-only-memory) 19, a CPU (central processing unit) 20 and a RAM (random-access memory) 21. The money amount indication signals (the segment signals S1–S7 and the digit strobe pulses DS1–DS3) inputted to the summing device 11 are applied to the CPU 20 through an interphase circuit 22. In this case, the segment signals S1–S7 are inputted to the CPU 20 after being converted to binary-coded decimal signals $D_{sg}$. The vend start signal VS inputted from the connector 15 to the summing device 11 is applied to the CPU 20 through the interphase circuit 24.

The CPU 20 includes a presently indicated amount register Mn' which stores data representing the presently indicated money amount and a previously indicated amount register Mn which stores data representing the immediately preceding indication of the money amount. In the CPU, contents stored in the two registers Mn' and Mn are compared with each other by a comparator COM to detect any variation. The CPU 20 further comprises counters $R_{10}$, $R_{50}$ and $R_{100}$ (provided not as independent counters but in the form of registers which function as counters when combined with arithmetic operation functions of the CPU 20) provided for respective denominations and the count of a suitable one of the counters $R_{10}$, $R_{50}$ and $R_{100}$ is counted up or counted down by 1 in accordance with the variation detected as a result of the comparison in the comparator COM.

The counters $R_{10}$, $R_{50}$, and $R_{100}$ function to sum up sales amounts by a single vending operation denomination by denomination and a total sum of sales for each denomination is stored in a total sales RAM 21. This total sales RAM 21 consists of money sections $R_{EX10}$, $R_{EX50}$ and $R_{EX100}$ and the counts of the counters $R_{10}$, $R_{50}$ and $R_{100}$ are respectively added to the contents of the corresponding money sections $R_{EX10}$, $R_{EX50}$ and $R_{EX100}$, the contents of the memory sections $R_{EX10}$, $R_{EX50}$ and $R_{EX100}$ being rewritten by the results of the addition. The contents of the counters $R_{10}$, $R_{50}$ and $R_{100}$ thereafter are cleared. A back-up circuit 25 detects disconnection of the CPU 20 from a power source if such disconnection occurs and thereupon supplies power to the RAM 21 from a back-up battery. Accordingly, the total sales RAM 21 functions practically as a non-volatile storage.

An output unit 26 is detachably connected to the summing device 11 through a connector 27. The output unit 26 is composed, for example, of a printer unit. In the summing device 11, total sales data for the respective denominations stored in the RAM 21 is supplied to the printer unit 26 through an interphase circuit 28 in response to a print order (PR) or a print and clear order (PC) produced by depression of a print key (not shown) or a print and clear key (not shown) whereby the total sales for the respective denominations are printed out. In case the print and clear order (PC) has been issued, the storage of the RAM 21 is cleared after it is printed out. The output unit 26 is not limited to the printer as described above but any device that can transcribe the contents of the RAM 21 in a portable form may be used.

Figure 4:
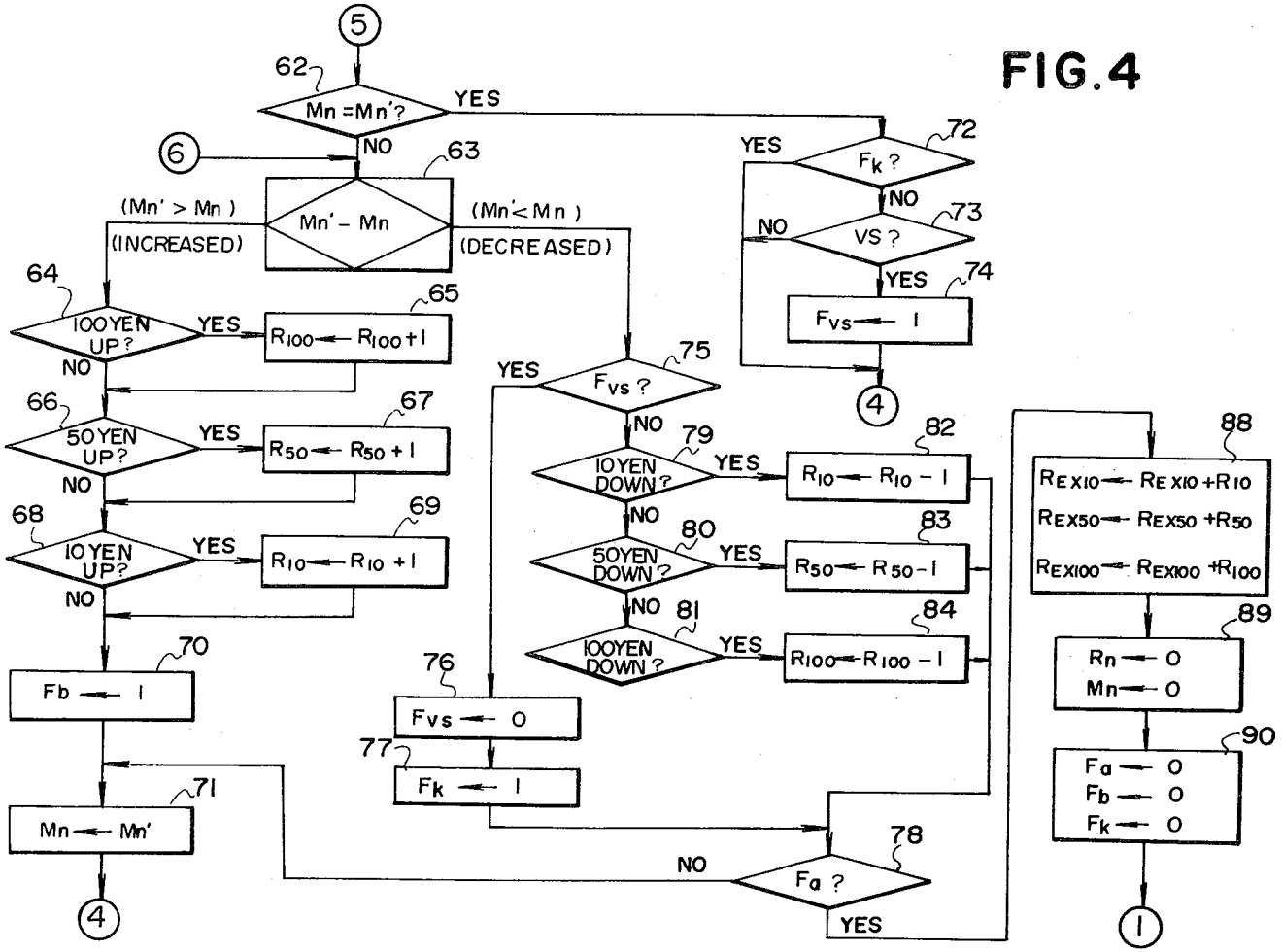

An example of a processing program implemented in the CPU 20 is shown in FIGS. 3 and 4.

Referring now to FIG. 3, as the program starts, contents of a working area (i.e., register means) in the CPU 20 are all cleared first by processing of "Step 50". In next step 51, a machine number proper to the summing device 11 is stored. This machine number is set by a machine number setter (not shown) provided in the summing device 11 and it is loaded in the CPU 20 and stored therein. This machine number is required for discriminating each individual vending machine from another in case a plurality of vending machines are installed. In next Step 52, whether an initialize key (not shown) is ON or not is judged. This initialize key is provided in the summing device 11 and is operated by a route man. When the initialize key is ON (i.e., the result of judgement in Step 52 is YES), processing of "$R_{Exn}$←0, $R_{EXpc}$←0" in Step 53 is effected. The processing of $R_{EXn}$←" clears all of the memory sections $R_{EX10}$, $R_{EX50}$ and $R_{EX100}$ in the total sales RAM21. The processing "$R_{EXPC}$←0" clears a printing times memory section $R_{EXpc}$ (not shown in FIG. 1) provided also in the RAM21. The printing times memory section $R_{EXpc}$ stores the number of times printing has been made in the printer unit 26. The initialize key becomes ON only temporarily at the initial time of the sales summing processing and the "Initialize?" in Step 52 normally is "NO".

In the Step 54 "PR?", whether a print order has been issued or not is judged. If the result of the judgement is No, processing of Step 55 "PC?" is implemented. In this step, whether a print and clear order has been issued or not is judged. If the result of the judgement is NO, processing proceeds to Step 29 "DS1?". In Steps 29, 30, 31 . . . labelled "DS1?", judgement is made as to whether the strobe pulse DS1 corresponding to the digit of 10(i.e. 10 yen) is present (i.e. "1") or not (i.e. "0"). If the pulse DS1 is present, the result of the judgement is YES and if not, the result is NO. If no coin has been deposited and indication of the money amount indicator 14 is "0", the pulse DS1 is not produced at all and the processing is restored to the Step 51 by the result "NO" in the Step 29.

upon deposition of a coin

Each time a coin has been thrown in the vending machine, the amount of the deposited coin is cumulatively counted by the up-down counter 16 of the changer device 12 and the indication of the money amount indicator 14 increases by the amount of the deposited coin. Accordingly, the digit strobe pulse DS1 is produced. Step 29 "DS1?" thereby becomes YES and the processing proceeds to Step 30 "DS1?". In the Step 30, an interval during which the pulse DS1 exists (i.e. YES) is a stand-by mode and the processing proceeds to next Step 31 upon falling of the pulse DS1 to "0" (i.e. NO). "DS1?" in this Step 31 functions to detect a "0" indication of the money amount indicator 14. If the result of the judgement is NO, the processing proceeds to Step 56 wherein a timer of 20 ms is operated to detect whether or not 20 ms has elapsed without generation of the pulse DS1 (i.e. "20 ms has elapsed? YES"). If any value (10 yen or more) is indicated in the money amount indicator 14, the strobe pulse DS1 is repeatedly produced as shown in FIG. 2 with a period shorter than 20 ms. If, accordingly, the indicator 14 indicates any value other than "0", the pulse DS1 is produced again while the processing is circulatingly performed in a loop from NO in Step 31 to NO in Step 56 so that "DS1?" in Step 31 becomes YES.

If Step 57 "$M_1' \leftarrow$Dsg", a value Dsg of the digit of 10 (i.e. digit of 10 yen) of the indicated amount which is provided from the encoder 23 to the CPU 20 in synchronism with the strobe pulse DSI is stored in a register $M_1'$ of the digit of 10 in the presently indicated amount register Mn'. Next, upon falling of the pulse DS1 to "0" (i.e., upon turning of "DS1?" in Step 32 to NO), the processing proceeds to judgement of "DS2?" in Step 33. In Steps 33 and 35 "DS2?", whether the strobe pulse DS2 which corresponds to the digit of 100 is present or not is judged. If Step 33 is YES, the processing proceeds to "$M_2$, $\leftarrow$Dsg" in Step 58 wherein a value Dsg of the digit of 100 of the indicated amount provided from the encoder 23 to the CPU 20 simultaneously with the strobe pulse DS2 is stored in a register $M_2'$. for the digit of 100 in the presently indicated amount register Mn'. If the strobe pulse DS2 is not present (i.e., the Step 33 is NO), this means absence of an amount of the digit of 100 or over. In this latter case, the processings of "$M_2' \leftarrow$0" in Step 59 and "$M_3' \leftarrow$0" in Step 60 are effected. Then processing forcibly change contents of the register $M_2'$ of the digit of 100 and a register $M_3'$ of the digit of 1,000 in the presently indicated amount register Mn' to 0.

After Step 58 "$M_2' \leftarrow$Dsg", the processing proceeds to Step 36 "DS3?" upon falling of the pulse DS2 to "0" (i.e., upon judgement of NO in Step 35 "DS2?"). In this "DS3?", judgement as to whether the strobe pulse DS3 corresponding to the digit of 1,000 has been produced or not is made. If "DS3?" is YES, it signifies that some numeral is indicated in the digit of 1,000. In this case, the processing proceeds to Step 61 wherein the value Dsg of the digit 1,000 of the money amount indicator which is provided to the CPU 20 from the encoder 23 simultaneously with generation of the pulse DS3 is stored in the register $M_3'$ of the digit of 1,000 in the presently indicated amount register Mn' ("$M_3' \leftarrow$Dsg"). If "DS3?" is NO, it signifies that there is no amount to be indicated in the digit of 1,000 in the money amount indicator. In this case, Step 60 "$M_3' \leftarrow$0" is implemented upon confirmation (YES) in Step 37 that the strobe pulse "DS1?" of the digit of 10 is produced again.

Reference numeral ⑤ in FIG. 3 connects to ⑤ in FIG. 4. Judgement of Step 52 "Mn=Mn'?" in FIG. 4 is made after the presently indicated amount of the indicator 14 is stored in the presently indicated amount register Mn' ($M_1'$, $M_2'$ and $M_3'$) in the above described manner. In this Step 62, judgement is made as to whether contents of the previously indicated amount indicator Mn are the same as those of the presently indicated amount indicator Mn'. Since the contents of the previously indicated amount register Mn initially are "0", they are not the same as those of the presently indicated amount register Mn' which have increased by the amount of the deposited coin and the processing proceeds to Step 63 "Mn'−Mn". In this Step 63, the contents of the register Mn are subtracted from the contents of the register Mn' and judgement is made as to whether the presently indicated amount has increased (i.e., Mn'>Mn) or decreased (i.e., Mn'<Mn). The presently indicated amount initially increases by deposition of a coin and the processing proceeds to the route of "Mn''>Mn". In Step 64, whether the result of the subtraction "Mn'−Mn" is +10 (i.e. increase by 100 yen) or not is judged and , if the result is YES, the processing proceeds to Step 65. Processing of "$R_{100} \leftarrow R_{100}+1$" in Step 65 counts up the contents of the 100-yen couner $R_{100}$ by 1. If Step 64 is YES, i.e., the indicated amount has increased by 100 yen at once, this signifies that one 100-yen coin has been received in the vending machine, so that the 100-yen counter $R_{100}$ is counted up by 1 in Step 65 to store the fact that one 100-yen coin has been received.

In a next Step 66, judgement is made as to whether the result of the subtraction "Mn'−Mn" in Step 63 is +5(i.e. increase of 50 yen) or not and, if the result is yes, processing of Step 67 is performed. In this Step 67, contents of the 50-yen counter $R_{50}$ are counted up by 1. In a next Step 68, judgement is made as to whether the result of the subtraction "Mn'−Mn" is +1 "i.e. increase of 10 yen" or not and, if the result is YES, processing of Step 69 is performed. In Step 69, contents of the 10-yen counter $R_{10}$ are counted up by 1.

In a case where amounts of coins of different denominations increase simultaneously, e.g. in a case where the amount which increases at once is 60 yen (i.e. simultaneous increase of a 10-yen coin and a 50-yen coin), 110 yen (i.e. simultaneous increase of a 10-yen coin and a 100-yen coin), 150 yen (i.e. simultaneous increase of a 50-yen coin and a 100-yen coin) or 160 yen (i.e. simultaneous increase of a 10-yen coin, a 50-yen coin and a 100-yen coin), processing is performed so that the judgement of Step 64 "100 yen up?" is made YES notwithstanding that the result of the subtraction is +11, +15, or +16 and the judgement of Step 68 "10 yen up?" is made YES notwithstanding that the result of the subtraction is +6, +11 or +16.

In Step 70, a coin deposition flag Fb is set to "1". This signifies a state in which a coin has been deposited and some amount other than 0 can be indicated in the money amount indicator. After the above described processing (i.e., counting up of the counters $R_{10}$, $R_{50}$ and $R_{100}$ for the respective denominations), the contents of the presently indicated amount register Mn' are transferred to the previously indicated amount register Mn (Mn←Mn') in Step 71. Processing thereafter jumps from ④ in FIG. 4 to ④ in FIG. 3.

Upon returning to 4 in FIG. 3, the previously described processing of Step 30 and thereafter is repeated. If there is sufficient time between deposition of one coin and a next one (i.e., while a next coin is not additionally deposited yet), the contents of the register Mn' ($M_1'$, $M_2'$ and $M_3'$) do not change at all even if the processing from ④ to ⑤ is performed. Accordingly, Step 62 "Mn=Mn'" in FIG. 4 in this case is YES and processing proceeds to Step 72. Since a vend processing flag Fk has not been set yet, Step 72 "FK?" is NO and processing proceeds to Step 73. Since the vend start signal VS has not been generated yet, Step 73 "VS?" is NO and the processing jumps to ④ in FIG. 4 again.

Upon additional deposition of a coin, the contents of the register Mn' ($M_1'$, $M_2'$ and $M_3'$) increase, in the processing from 3 to 5 in FIG. 3, by the amount of the additionally deposited coin as compared with the preceding count. Accordingly, Step 62 "Mn−Mn'?" in FIG. 4 is NO and Step 63 "Mn′−Mn" is (Mn′>Mn) so that the counter (one of the counters $R_1$, $R_{50}$, $R_{100}$) corresponding to the denomination of the additionally deposited coin is counted up by 1.

Upon completion of deposition of coins after repeating the above described processing, Step 62 "Mn=Mn′" is stabilized to the state of YES. At this time, the counters $R_{10}$, $R_{50}$ and $R_{100}$ for the respective denominations store the numbers of the coins of the respective denominations deposited. When the purchaser purchases an article by operating the selection switch after deposition of the coins, the vendor control unit 13 produces the vend start signal Vs for a certain duration of time. Step 73 "Vs?" on the route of "Mn=Mn′" YES thereby becomes YES and a vend start flag Fvs is set in Step 74 (Fvs←1).

processing upon starting vending

After setting of the vend start flag Fvs, the processing jumps to ④ in FIG. 3 again, repeating the route of Step 62 "Mn=Mn′" YES until the amount indicated in the money amount indicator 14 changes. In the meanwhile in the changer device 12 (FIG. 1), the vend price is subtracted from the contents of the up-down counter 16 in accordance with the vend start signal VS. Accordingly, the money amount indicating signal provided to the money amount indicator 14 decreases by the vend price after a lapse of some time. In accordance with this decrease, the contents of the presently indicated amount register Mn′ decreases by the vend price as compared with the contents of the previously indicated amount register Mn by the processing of ④ to ⑤ in FIG. 3. Accordingly, "Mn=Mn′?" becomes NO and "Mn′−Mn" becomes Mn′<Mn and the processing proceeds to Step 75. Since the vend start flag Fvs has been set, Step 75 "Fvs?" is YES and the processing proceeds to Step 76. In Step 76, the vend start flag Fvs is reset. Thereafter the vend processing flag Fk is set in Step 77 and the processing proceeds to Step 78. Since a finish flag Fa has not been set yet, Step 78 "Fa?" is NO and the processing proceeds to Step 71 in which the contents of the previously indicated amount register Mn are replaced by the contents of the presently indicated amount register Mn′. Accordingly, the contents of the previously indicated amount register Mn changes to an amount of change to be paid out (i.e., an amount obtained by subtracting the vend price from the amount of the deposited coin or coins). At this time, subtraction is not made in the counter $R_{10}$, $R_{50}$ $R_{100}$ for the respective denominations.

upon paying out of the change

When a change coin has been paid out, the amount indicated by the money amount indicator 14 decreases by the amount of the paid out coin. If the amount indicated after subtracting the amount paid out as the change has not reduced to 0, the remaining amount is stored in the presently indicated amount register Mn′ by the processing of ④ to ⑤ in FIG. 4. Accordingly, "Mn=Mn′" in FIG. 4 is NO and "Mn′−Mn" is Mn′<Mn, the difference corresponding to the denomination of the paid out coin. Since the vend start flag Fvs has already been reset, Step 75 "Fvs?" is No and the processing proceeds to Steps 79, 89 and 81. If the result of subtraction (Mn′−Mn) in Step 63 is −1(i.e., a 10-yen coin has been paid out), Step 79 "10 yen down?" is YES and the contents of the 10-yen counter $R_{10}$ is counted down by 1 by the processing "$R_{10}$←$R_{10}$−1" in Step 82. If the result of subtraction in Step 63 is −5(i.e., a 50 yen coin has been paid out), Step 80 "50 yen down?" is YES and the contents of the 50-yen counter $R_{50}$ are counted down by 1 by processing of Step 83. If the result of subtraction in Step 63 is −10 (i.e., a 100-yen coin has been paid out), Step 81 "100 yen down?" is YES and the contents of the 100-yen counter $R_{1000}$ are counted down by 1 by processing of Step 84. The processing proceeds to Step 78. Since the finish flag Fa has not been set yet, Step 78 is NO and the processing proceeds to Step 71 in which the contents of the presently indicated amount register Mn′ are stored in the previously indicated amount register Mn. Subsequently, the above described processing is repeated each time a change coin is paid out, the contents of the counter (one or $R_{10}$, $R_{50}$ and $R_{100}$) corresponding to the paid out coin being counted by 1.

Upon paying out of a last change coin, the amount indicated by the money amount indicator 14 is reduced to 0 and the digit strobe pulses DS1–DS3 cease to be produced. At this time, the conents of the previously indicated amount register Mn is the amount of the last coin to be paid out (10-yen, 50-yen or 100-yen coin). After ceasing of generation of the strobe pulse DS1, "DS1?" in Steps 30 and 31 remains to be NO and the duration of 20 ms of the 20 ms timer elapses. Accordingly, the processing proceeds to the route in which Step 56 is YES. First, setting of a coin deposition flag $F_b$ is confirmed (YES) in Step 85 and the contents of the presently indicated amount register Mn′ are reset to 0 by processing of Step 86. Then, the finish flag Fa is set in Step 87 and the processing jumps from ⑥ in FIG. 3 to ⑥ in FIG. 4, i.e., Step 62. Since at this time the previously indicated amount register Mn stores the amount of the last paid out coin, i.e., Mn′<Mn, the processing proceeds through Step 75 "Fvs?" No to steps 79, 80 and 81. The contents of the counter (one of $R_{10}$, $R_{50}$ and $R_{100}$) corresponding to the denomination of the last paid out coin are counted down by 1. In next Step 78, judgement is YES by setting of the finish flag Fa and the processing proceeds to Step 88. In Step 88, the contents of the counters $R_{10}$, $R_{50}$ and $R_{100}$ are respectively added to the contents of the money sections $R_{EX10}$, $R_{EX50}$ and $R_{EX100}$ of the total sales RAM21.

The contents stored at this time in each of the counters $R_{10}$, $R_{50}$ and $R_{100}$ is an amount left after subtracting the number of coin or coins of each denomination which have been paid out as the change from the number of deposited coin or coins of each denomination, i.e., the number of coin or coins of each denomination which has been accepted for the vend price. The contents of the 10-yen counter $R_{10}$ are added to the old contents of the memory section $R_{EX10}$ and the sum is newly stored in the memory section $R_{EX10}$ ($R_{EX10}$←$R_{EX10}$+$R_{10}$). The same is the case with the other memory sections $R_{EX50}$ and $R_{EX100}$ ($R_{EX50}$←$R_{EX50}$+$R_{50}$, $R_{EX100}$←$R_{EX100}$+$R_{100}$). Thus, the number of coins of each denomination is cumulatively summed in the memory sections $R_{EX10}$, $R_{EX50}$ and $R_{EX100}$ of the total sales RAM21. Then, the contents of the counters $R_{10}$, $R_{50}$ and $R_{100}$ for the respective denominations are all cleared ($R_n$←0) and the contents of the previously indicated amount register Mn are also cleared (Mn←0) in Step 89. Further, the flags Fa, Fb and Fk are reset in Step 90 and the processing thereafter jumps from 1 in FIG. 4 to 1 in FIG. 3.

When no change needs to be paid

If the amount indicated in the memory amount indicator 14 is 0 when the vend price has been subtracted in response to the vend start signal Vs, it means that there is no change that needs to be paid. In this case, the processing proceeds from Step 31 No through Step 56 YES to Step 86 and 87 and then jumps to ⑥ in FIG. 4. Step 75 in FIG. 4 is YES and the processing proceeds to Step 78. Since "Fa?" is YES, the processing proceeds immediately to step 88 in which the contents of the counters $R_{10}$, $R_{50}$ and $R_{100}$ are added to the content of the memory sections $R_{EX10}$, $R_{EX50}$ and $R_{EX100}$. Consequently, the processing is completed without going through the route of subtracting the numbers of coins paid out as the change in the counters $R_{10}$, $R_{50}$ and $R_{100}$ (Steps 79–84).

A case in which vending is cancelled

If vending is cancelled before it is implemented, no vend start signal VS is generated in the vending machine main body 10 and deposited coins are all returned to the purchaser. The amount indicated by the money amount indicator decreases at each paying out of the coins to be returned and judgement "Mn'<Mn" is made is Step 63 in FIG. 4. Since, however, the vend start flag Fvs is not set, the processing enters the route of steps 79–84 without going through the route of Steps 76 and 77 whereby the numbers of the deposited coins are all subtracted from the contents of the counters $R_{10}$, $R_{50}$ and $R_{100}$ for the respective denominations.

Printing

Printing is done during the stand-by mode. After completion of the series of summing processing, the processing jumps to ① in FIG. 3 and judgement is made as to whether the print order PR has been issued or not (PR?) or whether the print and clear order PC has been issued or not (PC?) If the judgement "PR?" is YES, the processing returns to ① after performing a predetermined "printing process" in Step 91. If the judgement "PC?" is YES, a predetermined "printing process" is made in Step 92 and thereafter the memory sections $R_{EX10}$, $R_{EX50}$ and $R_{EX100}$ of the total sales RAM 21 are all cleared by processing in Step 93. The processing thereafter returns to ①. In the "printing process" in Steps 91 and 92, e.g., "machine number", a past "number of printing", "number of 10-yen coins in the total sales" and "amount" thereof stored in the memory section $R_{EX10}$, "number of 50-yen coins in the total sales" and "amount thereof stored in the memory section $R_{EX50}$, "number of 100-yen coins in the total sales" and "amount" thereof stored in the memory section $R_{EX100}$ and the "total sales" are printed out.

Summing up of total sales by columns

FIG. 5 shows an embodiment in which total sales is Summed up by article dispensing columns. The embodiment shown in FIG. 5 is the same as that shown in FIG. 1 except that vend mode signals VS1-VSn for the respective columns are supplied from the vendor control unit 13 to the summing device 11 and that a vended-article-number-by-columns RAM 40 and a sales-amount-by-columns RAM 41 are additionally provided.

The following description is made with respect to features of the embodiment of FIG. 5 which are different from the embodiment of FIG. 1.

Referring to FIG. 5, the vendor control unit 13 consists of vend control devices 13-1 through 13-n corresponding to a plurality of columns C1, C2 . . . Cn, an article selection switch binary provided for each of the columns C1-Cn. If an article selected by the operation of the article selection switch is vendible, the article is delivered from one of the columns C1-Cn corresponding to the switch. The columns C1-Cn can respectively produce the vend mode-signals VS1-VSn and the vend mode signal (one of VS1-VSn) is produced (i.e., turned to "1") by one of the columns C1-Cn which has entered the vend mode (i.e. article delivery mode). A signal obtained by combining the vend mode signals VS1-VSn through a circuit 12 is the vend start signal VS. The respective vend mode signals VS1-VSn are supplied to the summing device 11 and applied to the CPU through the interphase circuit 24. As described previously, component parts Mn', MN, COM, $R_{10}$, $R_{50}$ and $R_{100}$ function as a computation means 42 which computes a vend price in accordance with increase or decrease of the money amount indication signal.

The vended-article-number-by-column RAM 40 consists of vended-article-number-by-columns memory sections Rc1, Rc2 . . . Rcn. Upon generation of the vend mode signal (one of VS1-VSn), 1 is added to contents of the memory section (one of Rc1-Rcn) corresponding to the column for which the vend mode signal has been generated. Accordingly, numbers of the vended articles by columns are cumulatively stored in the respective memory sections Rc1-Rcn. The sales-amount-by-columns RAM41 consists of sales-amount-by-columns memory sections RMc1, RMC2, . . . RMcn. Upon completion of a single vending, a total sum of the counts of the counters $R_{10}$, $R_{50}$ and $R_{100}$ for the respective denominations (i.e., the vend price of the dispensed article) is added to contents of the memory section (one of RMc1 RMcn) corresponding to the column for which the vend mode signal has been generated. Power source for these RAMs 40 and 41 is backed up by the back-up circuit 25 in the event of stoppage of electric current as is the case with the total sales RAM21.

Figure 6:
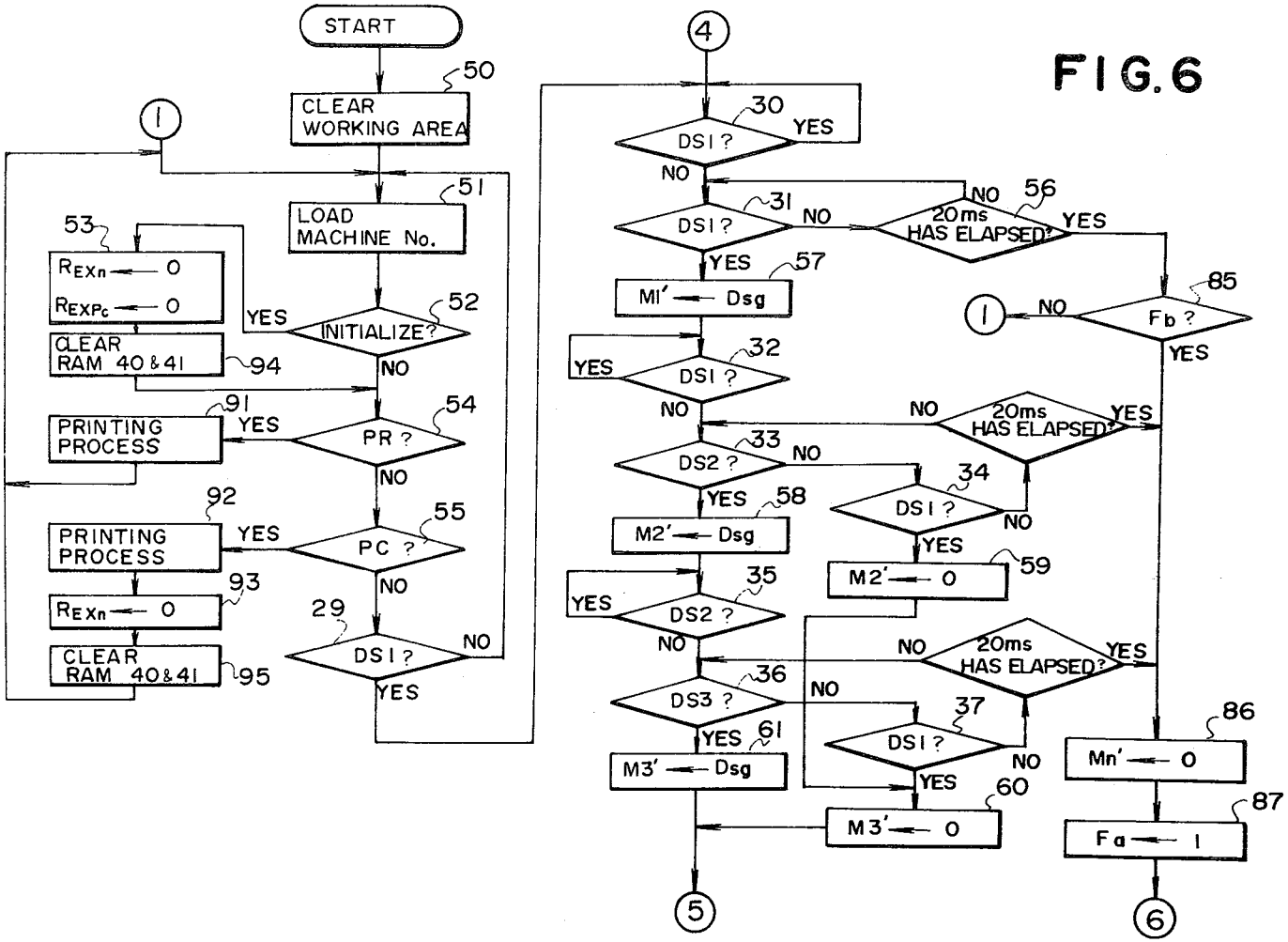
FIGS. 6 and 7 are flow charts showing an example of a summing processing program implemented in the summing device of FIG. 5.
Figure 7:
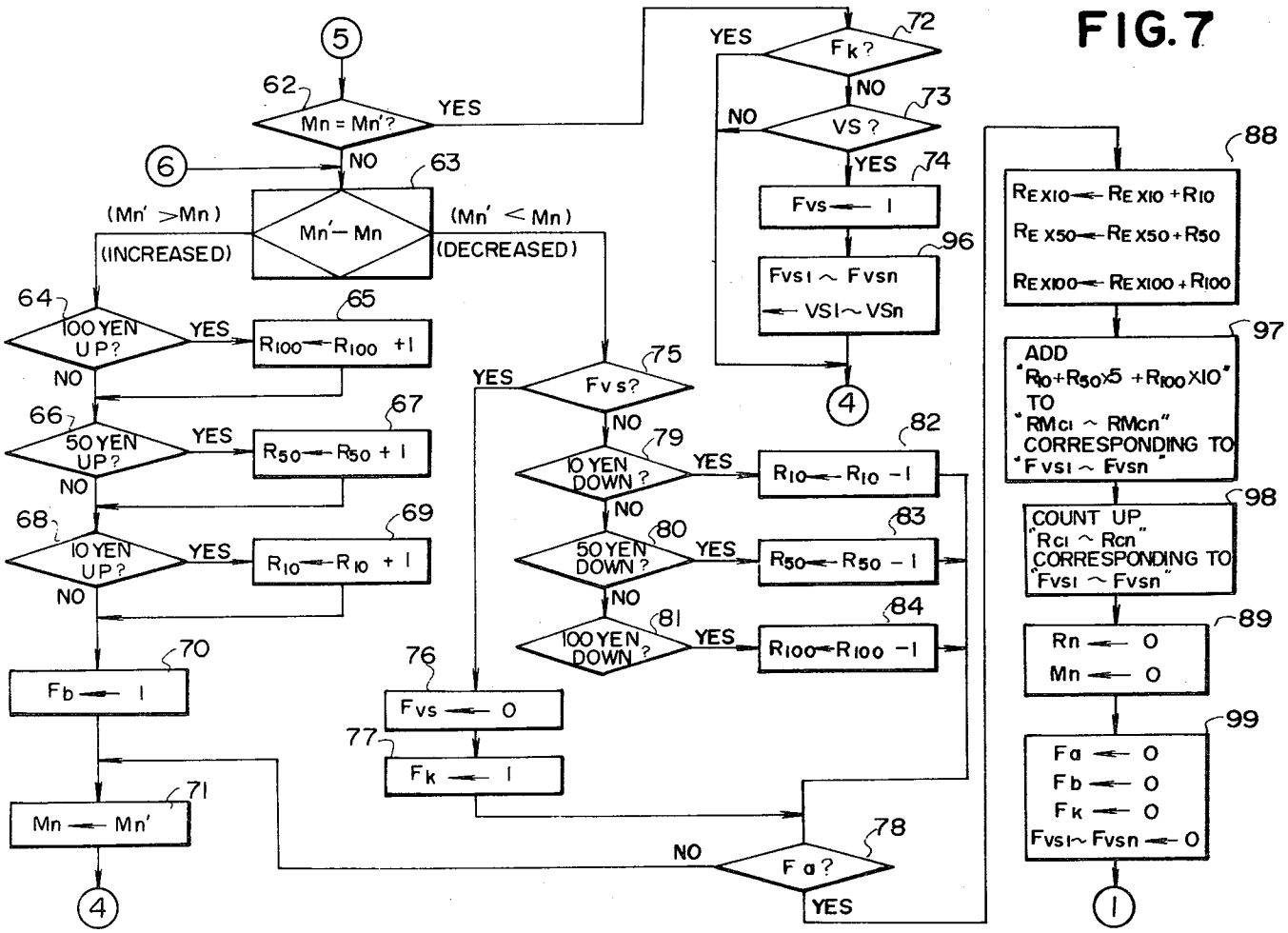

An example of a processing program implemented in the CPU 20 in FIG. 5 is shown in FIGS. 6 and 7.

The example shown in FIG. 6 is different from that shown in FIG. 3 in that Steps 94 and 95 are additionally provided whereas the example shown in FIG. 7 is different from that shown in FIG. 4 in that Steps 96, 97, 98 and 99 are additionally provided. In other respects, the example of FIG. 6 is the same as that of FIG. 3 and the example of FIG. 7 with that of FIG. 4. The above differences will be described in detail below.

In the example of FIG. 4, the vend start flag Fvs is set by processing of Step 74 during appearance of the vend start signal VS and the processing immediately jumps to ④ of FIG. 3. In contrast thereto, in the example of FIG. 7, Step 96 is provided after Step 74. When the purchaser purchases an article by depositing a coin and operating a selection switch for a desired column, a vend mode signal (one of VS1-VSn) corresponding to the selected column is generated for a certain period of time and this signal is applied to the CPU 20. If one of the vend mode signals VS1-VSn applied from the interphase circuit 24 to the CPU 20 is turned to "1", Step 73 "VS?" on the processing route in the case where Step 63 of FIG. 73 is YES becomes YES and the processing proceeds to Step 74 in which the vend start flag Fvs is set. Then the processing shifts to Step 96 in which "1" is set in one of vend mode flags Fvs1, Fvs2, . . . Fvsn corresponding to the column for which the vend mode signal (one of VS1-VSn) is being produced whereas "0" is set in the other flags (Fvs1-Fvsn←VS1-VSn). The processing then jumps to ④ in FIG. 6.

In the processing after paying out of change coins, i.e., the processing on the route of Step 78 YES in FIG. 7, Steps 97, 98 and 99 are newly provided. After Step 88 i.e., the processing of cumulative addition of the total sales in the total sales RAM 21, Step 97 is implemented.

In Step 97, a value obtained by adding together contents of the counters $R_{10}$, $R_{50}$ and $R_{100}$ counted at the same weight $R_{10}+R_{50}\times 5+R_{100}\times 10$ (i.e., the vend price of the article which has been sold just now) is added to contents of the memory section (one of RMc1-RMcn) of the sales-amount-by-columns RAM 41 corresponding to the vend mode flag which is set to "1" (one of Fvs1-Fvsn) and the result of the addition constitutes new contents stored in the particular memory section. Thus, total sales amounts for the respective columns are cumulatively summed in the respective memory sections RMc1-RMcn.

In next Step 98, contents of one of the memory sections Rc1-Rcn of the vended-article-number-by-columns RAM 40 corresponding to the vend mode flag (one of Fvs1-Fvsn) which has been set to "1" are counted up by 1, the result of counting up being made new contents of that memory section (one of Rc1-Rcn). Thus, the numbers of the vended articles by columns are summed up in the respective memory sections Rc1-Rcn.

Thereafter, the processing of Step 89 which is the same as the processing described with reference to FIG. 4 is implemented. Then, the processing proceeds to Step 99. Step 99 "Fa←0, Fb←0, Fk←0" is the same as Step 90 and the flag Fa, Fb and Fk are reset. "Fvs1-Fvsn←0" is processing for resetting the vend mode flag by columns Fvs1-Fvsn. The processing thereafter jumps to ① in FIG. 6.

Referring to FIG. 6, in Step 95 which is additionally provided in the route of Step 92 "Print Processing" and Step 94 which is additionally provided in the route of Step 52 "Initialize?" YES, the contents stored in the vended-article-number-by-columns RAM 40 and the sales-amount-by-columns RAM 40 and the sales-amount-by-columns RAM 41 are all cleared.

In the above-described embodiment, description has been made with respect to the case where denominations of coins deposited are 10 yen, 50 yen and 100 yen. Denominations of coins of course are not limited to the above.

In the above described embodiment, the vend start signal VS provided from the vendor-control unit 13 to the changer device 12 is utilized for subtracting the number of coins which have actually been paid out in the counters $R_{10}$, $R_{50}$ and $R_{100}$, disregarding decrease in the amount indication signal due to subtraction of the vend price. It is to be noted, however, that a signal which can be utilized for this purpose is not limited to the vend start signal VS but any signal will be useful if it can distinguish the cause of decrease in money amount signal in the money amount indicator 14 or the up-down counter 16, i.e., whether the decrease has been caused by subtraction of the vend price or by paying out of coins. For example, a signal indicating that each column in the vendor control unit has entered an article dispensing mode, a signal indicating that the vend price has been subtracted or a signal indicating that the vending machine has entered a coin (a change coin or a coin to be returned to the purchaser) pay-out mode may effectively be utilized for the above purpose. An arrangement may be made, for example, such that in case pay-out of change coins is requested upon completion of vending by depression of an account settle button, decrease in the money amount indication signal (i.e., the amount of paid out coins) after generation of an account settle signal is subtracted in counters for respective denominations in the summing device, disregarding the decrease in the money amount indication signal before the generation of the account settle signal.

The summing device 11 is not limited to a multi-function universal type device such as microcomputer employed in the above described embodiment but may be constituted of a combination of specially designed discrete circuits. Further, in the above described embodiment, the segment signals S1-S7 provided from the changer device in the money amount indicator 14 are drawn into the summing device 11 for being utilized as the money amount indication signal. The money amount indication signal is not limited to this but the contents of the up-down counter 16 in the changer device 12 may be directly drawn into the summing device 11 for utilization therein. The vending machine main body 10 may accept and process not only coins but also bills.

What is claimed is:

1. A total sales summing device for a vending machine, which vending machine includes counter means for cumulatively adding amounts of deposited coins and subtracting a vend price of a vended article and an amount of a paid out coin to obtain a balance of the amount of the deposited coins, characterized in that said summing device comprises:

first means for detecting increment and decrement in the balance of the deposited coins obtained by said counter means;

second means for conducting count-up or count-down in accordance with the increment or decrement in the balance of the deposited coins upon the detection by said first means; and third means for substantially prohibiting counting by said second means of decrement of the balance if the decrement has been caused by subtraction for collecting a vend price;

a sales amount being obtained by said second means by counting up and down only increment and decrement in the balance caused by deposition and paying out of a coin.

2. A total sales summing device as defined in claim 1 wherein said third means comprises:

signal take-in means for taking in a predetermined signal which is generated in the vending machine in collecting the vend price; and means for prohibiting downcounting by said second means of decrement caused in response to generation of said signal taken in by said take-in means.

3. A total sales summing device as defined in claim 2 in which said predetermined signal is a vend start signal representing that the vending machine has started vending of an article.

4. A total sales summing device as defined in claim 1 or 2 in which said second means comprises:

operation means which upcounts an increment detected by said first means whereas it downcounts a decrement detected by said first means while being controlled by said third means for prohibition of counting; and count and storage means for cumulatively adding a sales amount obtained by said operation means upon completion of each vending to obtain a total sales amount.

5. A total sales summing device as defined in claim 4 in which said operation means comprises means for discriminating the denomination of a deposited or paid out coin in accordance with the detected increment or decrement and counters for respective denominations which conduct upcounting and downcounting in accordance with the increment and decrement and in correspondence to the discriminated denomination, and said count and storage means cumulatively adds contents of said counters for respective denominations to obtain sales amounts by denominations.

6. A total sales summing device as defined in claim 1 in which the vending machine further comprises a money amount indicator for indicating a money amount obtained by said counter means and said first means comprises take-in means for taking in money amount indication data supplied from said counter means to said money amount indicator and data variation detection means for detecting increase and decrease in the money amount indication data taken in by said take-in means.

7. A total sales summing device as defined in claim 6 in which said take-in means comprises connector means provided in a money amount indication transmission route from said counter means to said money amount indicator so as to take the money amount indication data into the summing device through said counter means.

8. A total sales summing device as defined in claim 7 in which the money amount indication data taken in by said connector means consists of signals produced by time division multiplexing segment signals corresponding to indication elements of respective digits of said money amount indicator and digit strobe pulses representing time shared generation timing of the respective digits and said take-in means further comprises an encoder for converting said segment signals to indication numerical data expressed in binary-coded decimal notation and means for causing the indication numerical data sent out from said encoder to correspond to proper digits in response to the digit strobe pulses.

9. A total sales summing device as defined in claim 6 in which said data variation detection means comprises a presently indicated amount register storing the money amount indication data taken in by said take-in means, a previously indicated amount register storing immediately preceding money amount indication data and comparison means for comparing counts of the two registers for judging variation in the money amount to be indicated.

10. A total sales summing device for a vending machine, which vending machine includes counter means for cumulatively adding amounts of deposited coins and subtracting a vend price of a vended article and an amount of a paid out coin to obtain a balance of the amount of the deposited coins and a plurality of article dispensing columns, characterized in that said summing device comprises:

means for detecting increment and decrement in the balance of the amount of deposited coins obtained by said counter means:

computation means for computing a vend price collected by the vending machine by upcounting the detected increment disregarding the detected decrement when it has been caused by subtraction for collecting the vend price and downcounting the detected decrement caused for other reason; and sales amount counting and storage means provided for respective columns for cumulatively adding the vend price which has been computed by said operation means in accordance with the column from which a vended article has been dispensed.

11. A total sales summing device as defined in claim 10 in which said computation means includes means for taking in vend mode signals representing columns which have entered a vend mode from the vending machine for disregarding the decrement detected in accordance with generation of the vend mode signals and said sales amount counting and storage means cumulatively counts vend prices in accordance with a column for which the vend mode signal has been generated.

* * * * *